US008570234B2

(12) United States Patent
Tsai et al.

(10) Patent No.: US 8,570,234 B2
(45) Date of Patent: Oct. 29, 2013

(54) ASSEMBLY OF CHIP ANTENNA AND CIRCUIT BOARD

(75) Inventors: Meng Hsueh Tsai, New Taipei (TW); Chih Ming Su, Taipei (TW); Lee Ting Hsieh, Pingtung County (TW)

(73) Assignee: Inpaq Technology Co., Ltd., Miaoli (TW)

( * ) Notice: Subject to any disclaimer, the term of this patent is extended or adjusted under 35 U.S.C. 154(b) by 288 days.

(21) Appl. No.: 13/077,014

(22) Filed: Mar. 31, 2011

(65) Prior Publication Data

US 2011/0291910 A1 Dec. 1, 2011

(30) Foreign Application Priority Data

May 31, 2010 (TW) ..... 99210231 U

(51) Int. Cl.
*H01Q 1/48* (2006.01)

(52) U.S. Cl.
USPC ..... 343/848; 343/702

(58) Field of Classification Search
USPC ..... 343/848, 702, 700
See application file for complete search history.

(56) References Cited

U.S. PATENT DOCUMENTS

| | | | | |
|---|---|---|---|---|
| 7,443,346 | B2 * | 10/2008 | Shih | 343/700 MS |
| 2007/0247370 | A1 * | 10/2007 | Hu et al. | 343/700 MS |
| 2009/0046019 | A1 * | 2/2009 | Sato | 343/702 |
| 2011/0215972 | A1 * | 9/2011 | Wong et al. | 343/702 |

* cited by examiner

*Primary Examiner* — Ahshik Kim
(74) *Attorney, Agent, or Firm* — WPAT, P.C.; Anthony King

(57) ABSTRACT

An assembly of a chip antenna and a circuit board includes a chip antenna and a circuit board. The circuit board includes a ground layer. The ground layer includes a hollow region formed adjacent to a periphery of the ground layer. The hollow region of the ground layer can be used for configuring an input impedance of the circuit board. The chip antenna is disposed in the hollow region of the ground layer, electrically connecting to the ground layer. The chip antenna includes input impedance. The input impedance of the chip antenna is adjustable to achieve a conjugate impedance match between the chip antenna and the circuit board such that the circuit board and the chip antenna can simultaneously radiate electromagnetic energy.

7 Claims, 6 Drawing Sheets

ASSEMBLY OF CHIP ANTENNA AND CIRCUIT BOARD

BACKGROUND OF THE INVENTION

1. Technical Field

The present invention relates to an assembly of a chip antenna and a circuit board, and relates more particularly to an assembly of a chip antenna and a circuit board including a ground layer that can radiate electromagnetic energy with the chip antenna.

2. Background

Due to the increasing need for high data column transmission, the technology for broadening of wireless networks is developing quickly. For example, the worldwide interoperability for microwave access (WiMax) technique supported strongly by international major companies such as Intel Corporation is rapidly emerging. According to the 802.16e standard, if the WiMax technique is applied, the wireless transmission frequency used between mobile devices such as notebooks and base stations can be in a range of from 2 to 6 GHZ, consequently capable of transmitting video and audio contents with better quality and instant messages.

In addition to the WiMax standard, the present invention can be embodied compliant with wireless standards such as GSM, DCS/PCS, GPS, BT, WiLan, WiFi, etc., and is not limited to the above-mentioned transmission bandwidths and methods of signal transmission.

During the rapid development of the communication industry, the performance of antennas has been a major key factor to the overall performance of wireless communication devices. However, as electronic devices are required to be compact, the antennas cannot perform as required within targeted frequency bands. Poor performance reflects the design difficulty of the antennas. Specifically, when the radiation metal surface area of a chip antenna is reduced, the electromagnetic wave emission efficiency of the antenna is decreased.

Thus, the issues relating to the reduced bandwidths and efficiencies of antennas due to miniaturization need to be resolved.

SUMMARY

The present invention provides an assembly of a chip antenna and a circuit board. The ground layer in the circuit board and the chip antenna are integrally configured to radiate electromagnetic energy. Changes in the ground layer layout in the circuit board can have corresponding effects on resistance and reactance. Signals can be sent from the chip antenna to the ground layer, then radiated from the ground layer. Thus, the ground layer can be used as an electromagnetic radiation metal layer, consequently increasing the electromagnetic radiation efficiency and bandwidth. As a result, it is possible to resolve the issues relating to the reduced bandwidths and efficiencies of antennas due to miniaturization.

One embodiment of the present invention comprises a chip antenna and a circuit board. The circuit board comprises a ground layer. The ground layer includes a hollow region formed adjacent to a periphery of the ground layer. The hollow region of the ground layer can be used for configuring an input impedance of the circuit board. The chip antenna is disposed in the hollow region of the ground layer, electrically connecting to the ground layer. The chip antenna creates input impedance. The input impedance of the chip antenna is adjustable to achieve a conjugate impedance match between the chip antenna and the circuit board such that the circuit board and the chip antenna can simultaneously radiate electromagnetic energy. In one embodiment of the present invention, the hollow region of the ground layer is located at the center of a long edge of the circuit board.

The foregoing has outlined rather broadly the features of the present invention in order that the detailed description of the invention that follows may be better understood. Additional features of the invention will be described hereinafter, and form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

The objectives of the present invention will become apparent upon reading the following description and upon reference to the accompanying drawings in which.

DETAILED DESCRIPTION

Figure 1:
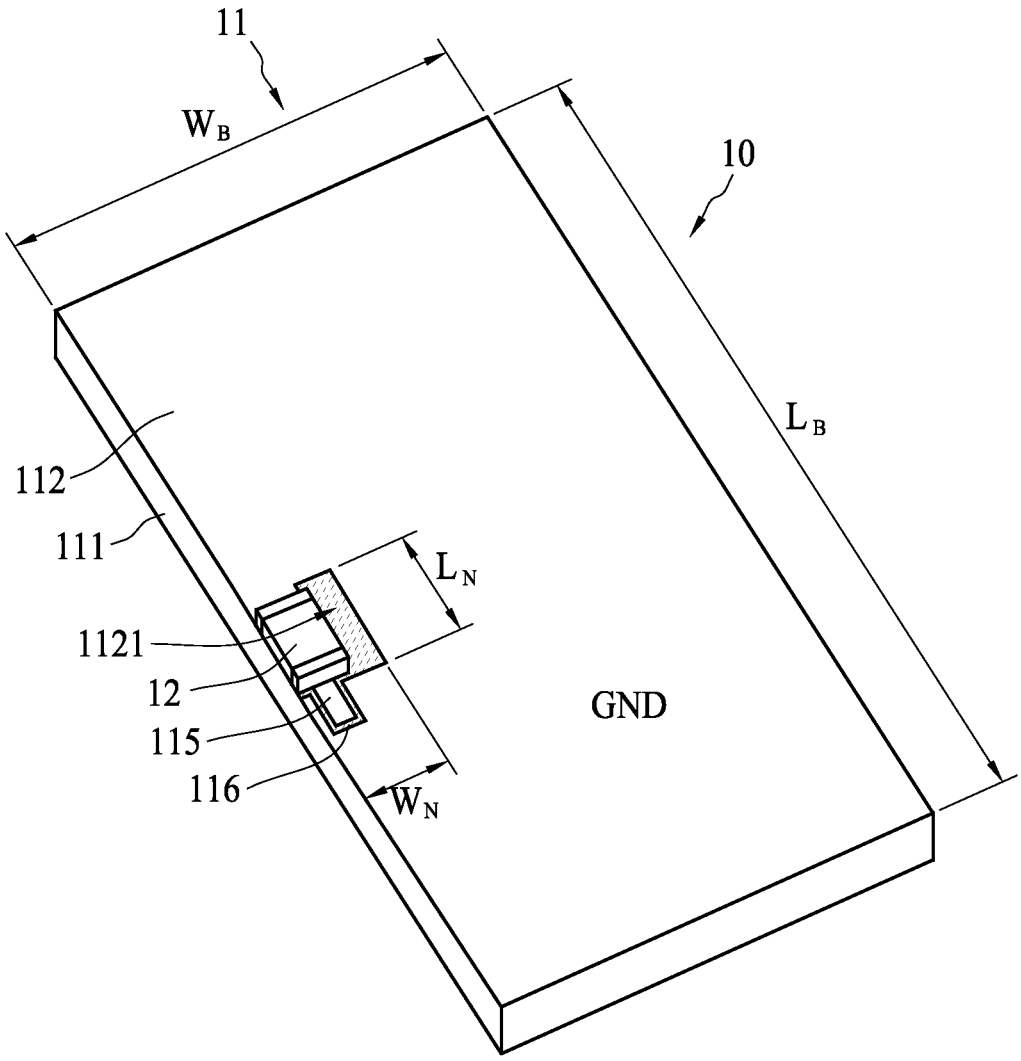
FIG. 1 is a view showing an assembly of a chip antenna and a circuit board according to one embodiment of the present invention.

FIG. 1 is a view showing an assembly of a chip antenna and a circuit board according to one embodiment of the present invention. An assembly 10 of a chip antenna and a circuit board comprises a chip antenna 12 and a circuit board 11. The circuit board 11 comprises at least one dielectric layer 111 of, for example, FR4 fiber glass reinforced resin or ceramic and a ground layer 112. The ground layer 112 comprises a hollow region 1121 formed adjacent to the periphery of the ground layer 112. The chip antenna 12 is located in the hollow region 1121 of the ground layer 112. A ground electrode of the chip antenna 12 connects to the ground layer 112. The chip antenna 12 includes a signal electrode connecting to a microstrip line 115, which includes a feeding point configured for receiving an input signal.

Through the configuration of the hollow region 1121 of the chip antenna 12, a desired input impedance of the circuit board 11 can be obtained. The adjustment of the input impedance of the circuit board 11 can allow the circuit board 11 and the chip antenna 12 to achieve a conjugate impedance match.

The chip antenna 12 includes a signal electrode (not shown). The signal electrode connects to a signal source (not shown). The chip antenna 12 further includes a ground electrode (not shown) connecting to the ground layer 112. In the present embodiment, the circuit board 11 and the ground layer 112 have a length $L_B$ and a width $W_B$. The hollow region 1121 has a length $L_N$ and a width $W_N$. The location and dimension of the hollow region 1121 affect the impedance of the ground layer 112. The adjustment of the input impedance of the chip antenna 12 can offset the reactance of the ground layer 112, and can extend the effective radiation metal surface of the antenna. As a result, the ground layer 112 and the chip antenna 12 can simultaneously emit electromagnetic energy. In other words, the ground layer 112 can be deemed a metal layer having a large area for effectively radiating electromagnetic waves carrying signals from the signal source into the atmosphere. The hollow region 1121 can have a shape of rectangle, regular polygon, or can be irregular.

Figure 2:
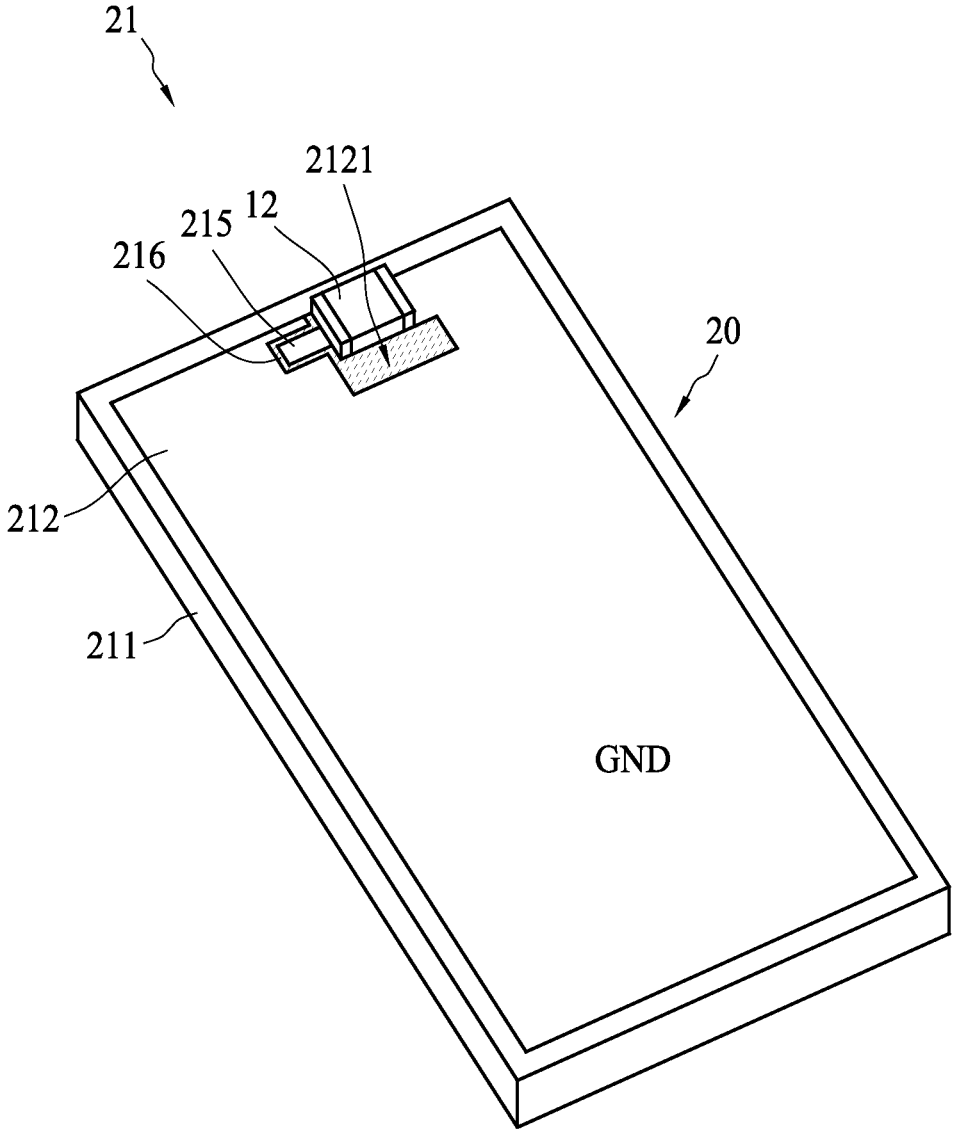
FIG. 2 is a view showing an assembly of a chip antenna and a circuit board according to another embodiment of the present invention.

FIG. 2 shows an assembly of a chip antenna and a circuit board according to another embodiment of the present invention. An assembly 20 of a chip antenna and a circuit board comprises a chip antenna 12 and a circuit board 21. The circuit board 21 includes at least one dielectric layer 211 and a ground layer 212 including a hollow region 2121 formed adjacent to the periphery of the ground layer 212. The chip antenna 12 is located in the hollow region 2121 of the ground layer 212. The hollow region 2121 can be, as demonstrated in the present embodiment and the prior embodiment, located adjacent to the center position of an edge of the ground layer 212. The hollow region 2121 can also be formed at a corner of the ground layer 212, namely at a right angle corner. The chip antenna 12 includes a signal electrode connecting to a signal source (not shown) and a ground electrode (not shown) connecting to the ground layer 212. The signal electrode of the chip antenna 12 connects to a micro-strip line 215 having a feeding point configured for receiving an input signal.

The location and dimension of the hollow region 2121 affect the impedance of the ground layer 112. The adjustment of the input impedance of the chip antenna 12 can offset the reactance of the ground layer 212, and can extend the effective radiation metal surface of the antenna. As a result, the ground layer 212 and the chip antenna 12 can simultaneously emit electromagnetic energy.

Figure 3A:
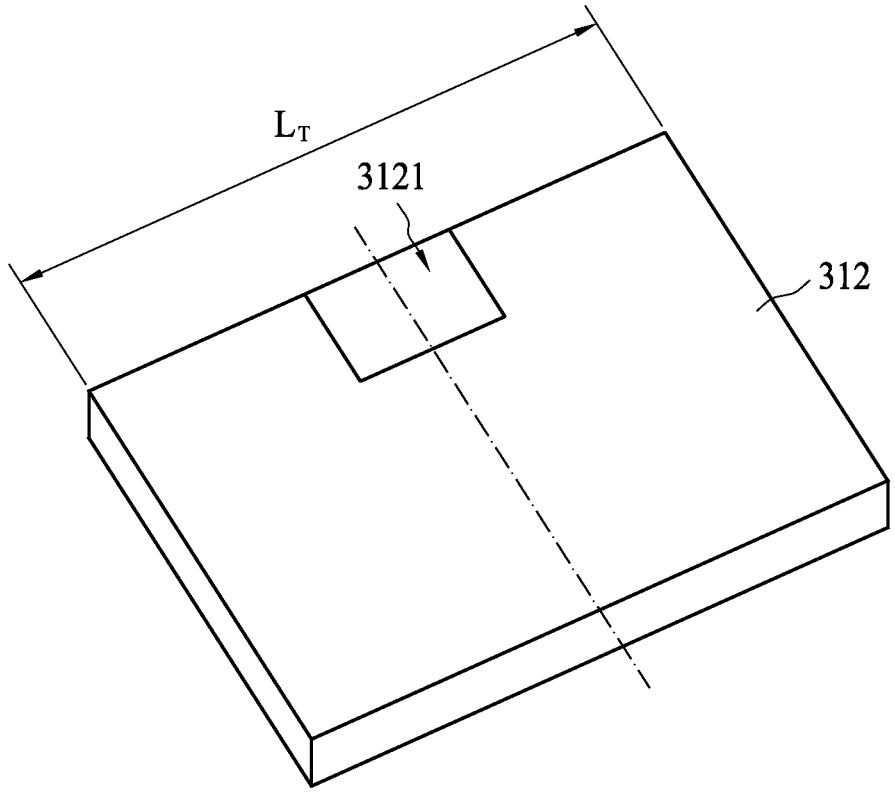
FIG. 3A is a perspective view showing a circuit board having a length $L_T$ according to one embodiment of the present invention.
Figure 3B:
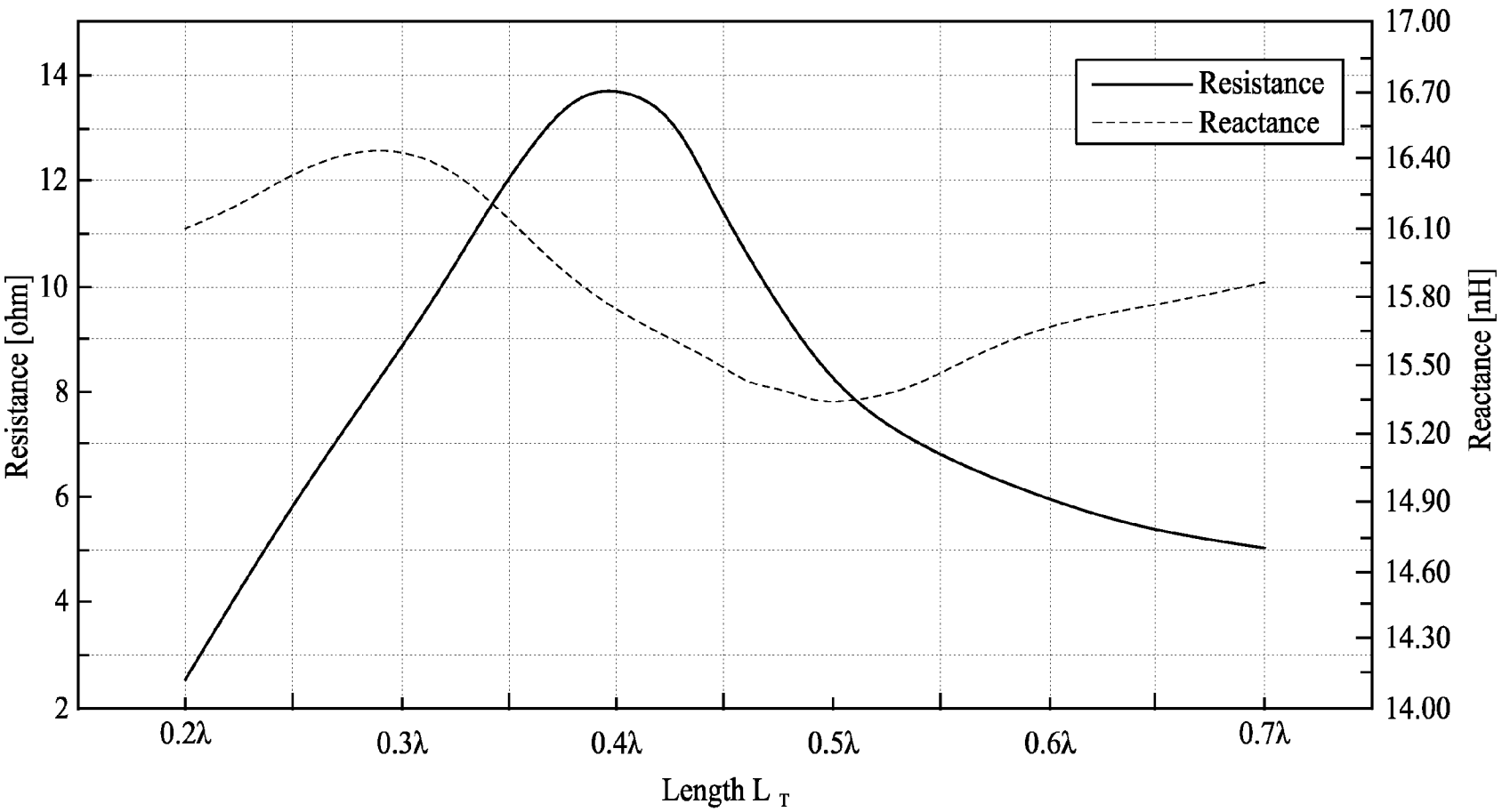
FIG. 3B is a graph showing the relationships between the length $L_T$ of a circuit board and resistance, and between the length $L_T$ of a circuit board and reactance according to one embodiment of the present invention.

FIG. 3A is a perspective view showing a circuit board having a length $L_T$ according to one embodiment of the present invention. Referring to FIG. 3A, the hollow region 3121 of the ground layer 312 is centrally positioned on the circuit board. The length $L_T$ of the circuit board may vary simultaneously with that of the ground layer 312. FIG. 3B is a graph showing the relationships between the length $L_T$ of a circuit board and resistance, and between the length $L_T$ of a circuit board and reactance according to one embodiment of the present invention. In such a graph, the resistances and the reactances corresponding to different lengths $L_T$ of a circuit board are shown. According to the requirements, a circuit board with a suitable length $L_T$ can be selected. By balancing the reactance of the circuit board with the input resistance of the chip antenna, desired antenna characteristics can be acquired.

Figure 4A:
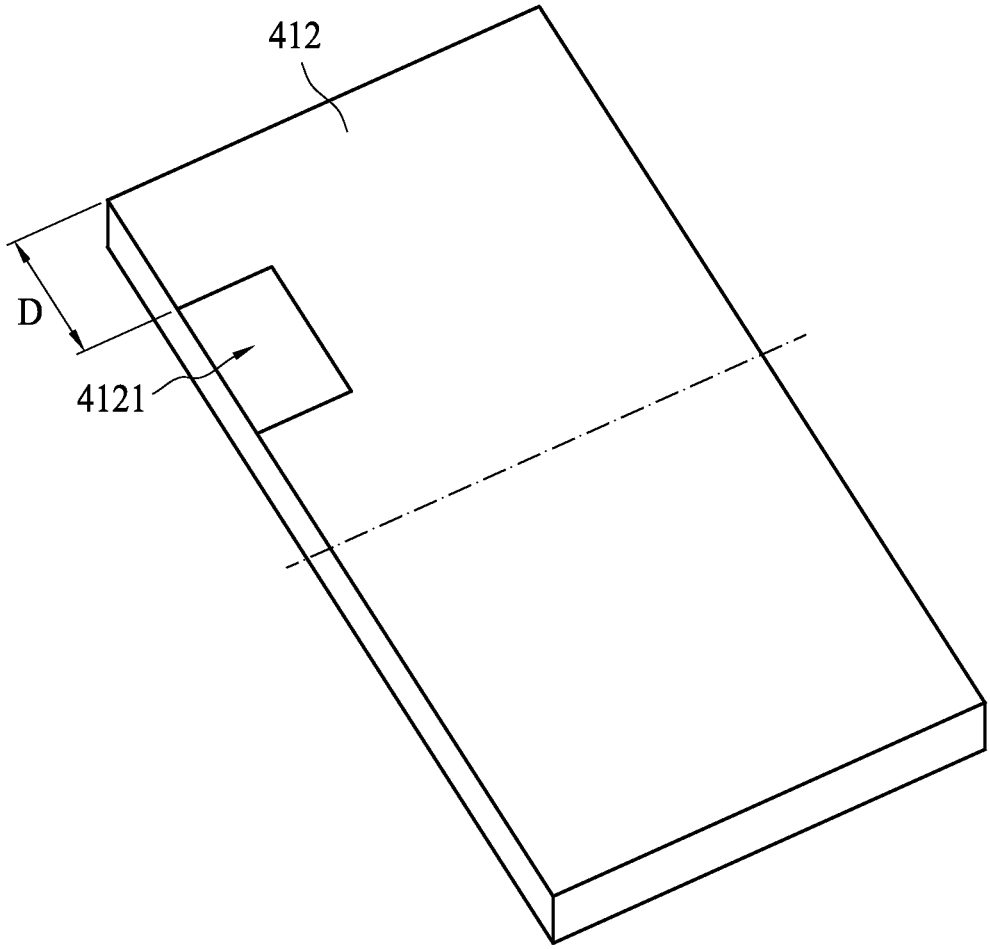
FIG. 4A is a perspective view showing the hollow region of a ground layer located according to one embodiment of the present invention.
Figure 4B:
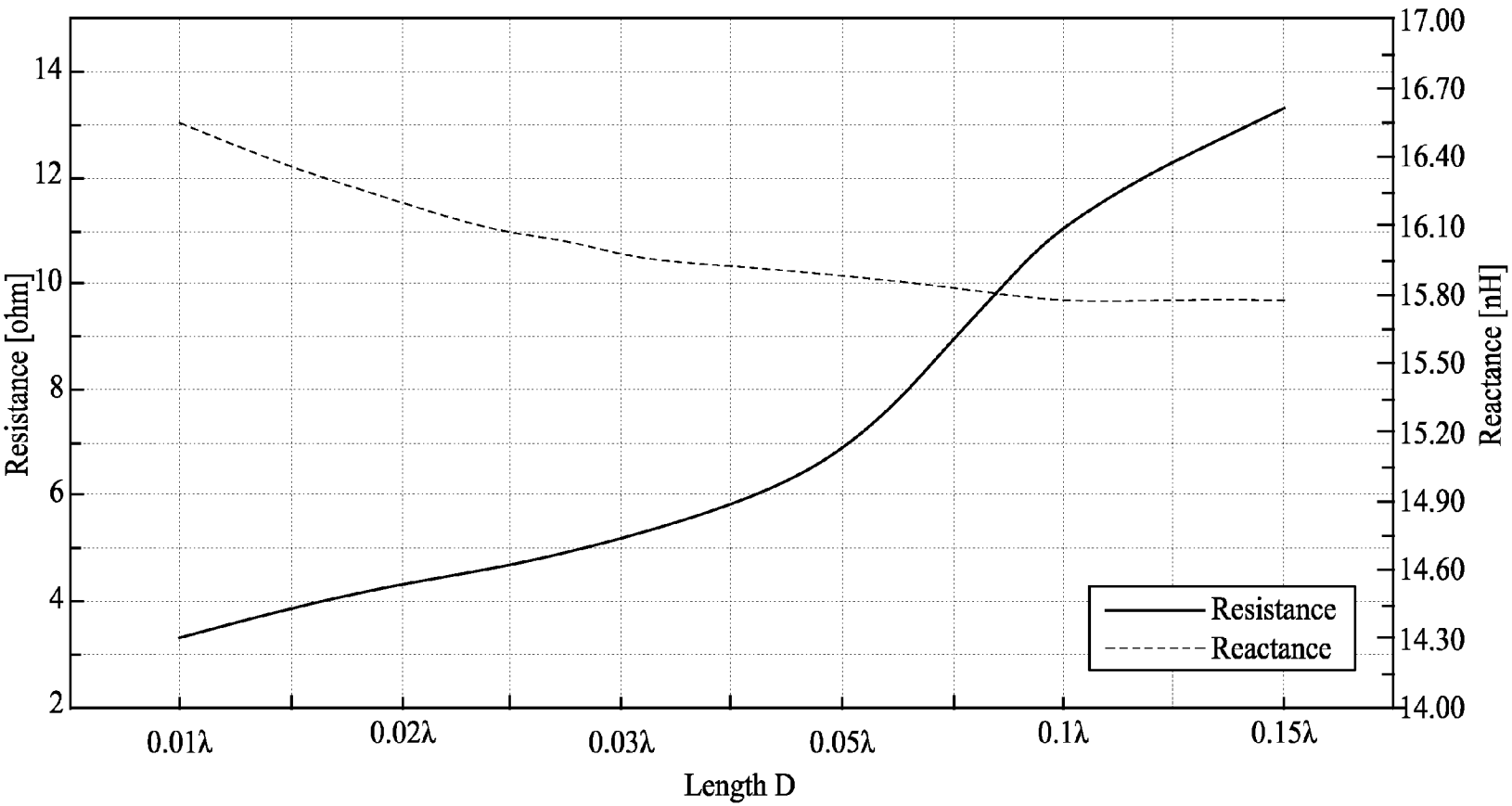
FIG. 4B is a graph showing the relationships between the position of the hollow region of a ground layer and resistance, and between the position of the hollow region of a ground layer and reactance according to one embodiment of the present invention.

FIG. 4A is a perspective view showing the hollow region of a ground layer located according to one embodiment of the present invention. As shown in FIG. 4A, the hollow region 4121 of a ground layer 412 can be moved along a long edge of the circuit board. Namely, the distance D between the hollow region 4121 and a short edge of the circuit board is variable. The hollow region 4121 has a fixed dimension. FIG. 4B is a graph showing the relationships between the position of the hollow region of a ground layer and resistance, and between the position of the hollow region of a ground layer and reactance according to one embodiment of the present invention. In FIG. 4B, it can be seen that as the hollow region 4121 is moved closer to the center position of the long edge of the circuit board, the resistance become higher, resulting in better electromagnetic radiation efficiency. In fact, the arrangement of the hollow region 4121 is similar to that of traces of a circuit board. The hollow region 4121 is not easily arranged adjacent to the center of the long edge.

Although the present invention and its objectives have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An assembly of a chip antenna and a circuit board, comprising:

a circuit board comprising a ground layer including a hollow region formed adjacent to a periphery of the ground layer, wherein an input impedance of the circuit board is configured by the hollow region of the ground layer; and a chip antenna disposed in the hollow region of the ground layer, electrically connecting to the ground layer, including an input impedance;

wherein the input impedance of the chip antenna is adjustable to achieve a conjugate impedance match between the chip antenna and the circuit board, and the hollow region is configured to allow the circuit board and the chip antenna to simultaneously radiate electromagnetic energy;

wherein the chip antenna and the ground layer are disposed on the same surface of the circuit board.

2. The assembly of claim 1, wherein the ground layer is rectangular, and the hollow region is adjacent to a long edge of the ground layer.

3. The assembly of claim 2, wherein the hollow region is located adjacent to the center of the long edge.

4. The assembly of claim 2, wherein the hollow region is at any position adjacent to a short edge or at any corner.

5. The assembly of claim 1, wherein the hollow region has a shape of rectangle or regular polygon, or is irregular.

6. The assembly of claim 1, further comprising a micro-strip line electrically connecting to a signal electrode.

7. The assembly of claim 6, wherein the micro-strip line includes a feeding point for receiving an input signal.

* * * * *